US009813818B2

(12) United States Patent
Wu et al.

(10) Patent No.: US 9,813,818 B2
(45) Date of Patent: Nov. 7, 2017

(54) SPEAKER

(71) Applicants: Shuwen Wu, Shenzhen (CN); Wei Song, Shenzhen (CN)

(72) Inventors: Shuwen Wu, Shenzhen (CN); Wei Song, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/082,316

(22) Filed: Mar. 28, 2016

(65) Prior Publication Data

US 2017/0048621 A1 Feb. 16, 2017

(30) Foreign Application Priority Data

Aug. 10, 2015 (CN) ..... 2015 2 0598326 U

(51) Int. Cl.

| | |
|---|---|
| ***H04R 1/02*** | (2006.01) |
| ***H04R 9/04*** | (2006.01) |
| ***H04R 7/12*** | (2006.01) |
| ***H04R 9/02*** | (2006.01) |
| ***H04R 9/06*** | (2006.01) |

(52) U.S. Cl.

CPC ..... *H04R 9/043* (2013.01); *H04R 7/127* (2013.01); *H04R 9/025* (2013.01); *H04R 9/06* (2013.01); *H04R 2307/027* (2013.01)

(58) Field of Classification Search

CPC ..... H04R 9/025; H04R 2499/11; H04R 9/06; H04R 31/006; H04R 1/06; H04R 9/02; H04R 9/043; H04R 2400/11; H04R 9/045; H04R 9/10; H04R 2307/207; H04R 31/003; H04R 7/18; H04R 9/04; H04R 9/063

USPC ..... 381/400–410, 421–425, 433

See application file for complete search history.

(56) References Cited

U.S. PATENT DOCUMENTS

| | | | | |
|---|---|---|---|---|
| 2005/0241876 | A1* | 11/2005 | Sperle | H04R 1/025 181/150 |
| 2007/0071274 | A1* | 3/2007 | Andersen | H04R 1/06 381/404 |
| 2009/0200101 | A1* | 8/2009 | Baker | H04R 7/127 181/148 |
| 2011/0026831 | A1* | 2/2011 | Perronnin | G06F 17/30244 382/197 |
| 2011/0268310 | A1* | 11/2011 | Bullimore | H04R 7/26 381/398 |
| 2011/0299716 | A1* | 12/2011 | Reckert | H04R 7/02 381/398 |
| 2013/0182885 | A1* | 7/2013 | Fujitani | H04R 3/00 381/412 |
| 2014/0056464 | A1* | 2/2014 | Li | H04R 9/025 381/400 |

(Continued)

FOREIGN PATENT DOCUMENTS

CN 102611970 A * 7/2012

*Primary Examiner* — Md S Elahee
*Assistant Examiner* — Julie X Dang
(74) *Attorney, Agent, or Firm* — Na Xu; IPro, PLLC

(57) ABSTRACT

A speaker is disclosed. The speaker includes a magnetic circuit system; a vibration system including a vibrating diaphragm, a voice coil for driving the vibrating diaphragm, and a silicone gel spider elastically supporting the voice coil. The speaker further includes a high temperature resistant support ring attached with the voice coil and the silicone spider.

8 Claims, 2 Drawing Sheets

(56) References Cited

U.S. PATENT DOCUMENTS

2014/0376766 A1* 12/2014 Chen ..... H04R 9/02
381/400

* cited by examiner

SPEAKER

FIELD OF THE DISCLOSURE

The present disclosure generally relates to electro-acoustic transducers, and more particularly to a miniature speaker.

BACKGROUND

With the rapid development of technology, audio devices are more and more popular. The people require not only the video and audio playing function of the audio devices, but also require higher reliability of audio devices. In particular incoming 3G era, mobile multimedia technologies are developed also and many audio devices have many entertainment features, such as video playing, digital camera, games, GPS navigation and so on. More sophisticated and compact electronic components are required in audio devices.

In audio devices, a speaker is a common electronic component and mainly used for playback of audio signals. In existing speaker, in order to make the voice coil vibrate stably, a spider is provided at the lower portion of the voice coil. When the spider is made of silicone gel, as the voice coil is fixed directly on the silicone gel spider and the silicone gel is smooth and is deformed easily, plus high temperature created on the voice coil after working, the voice coil is detached easily from the silicone gel spider.

Therefore, it is desired to provide a new speaker which can overcome the aforesaid problem.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and an exemplary embodiment thereof.

Figure 1:
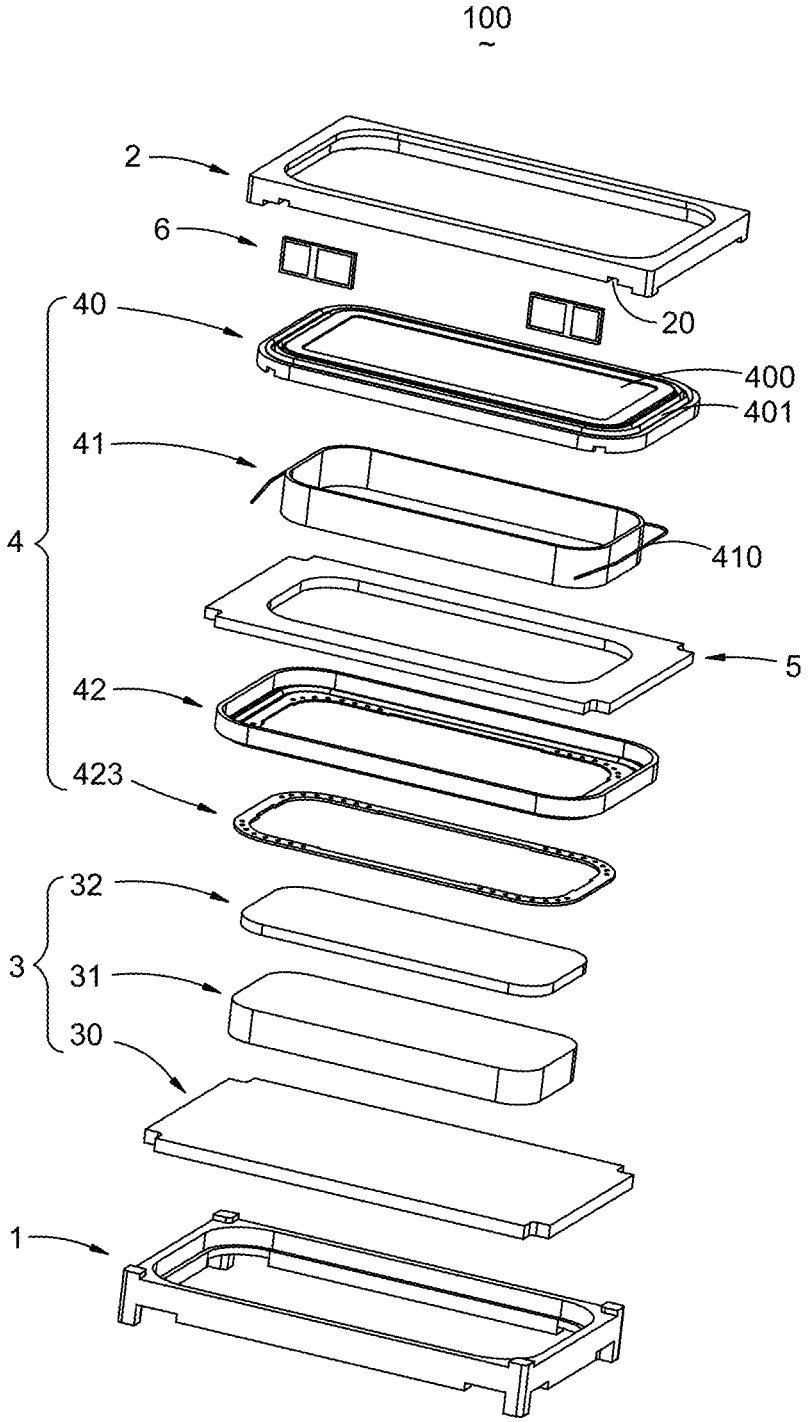
FIG. 1 is an isometric and exploded view of a speaker in accordance with an exemplary embodiment of the present disclosure.
Figure 2:
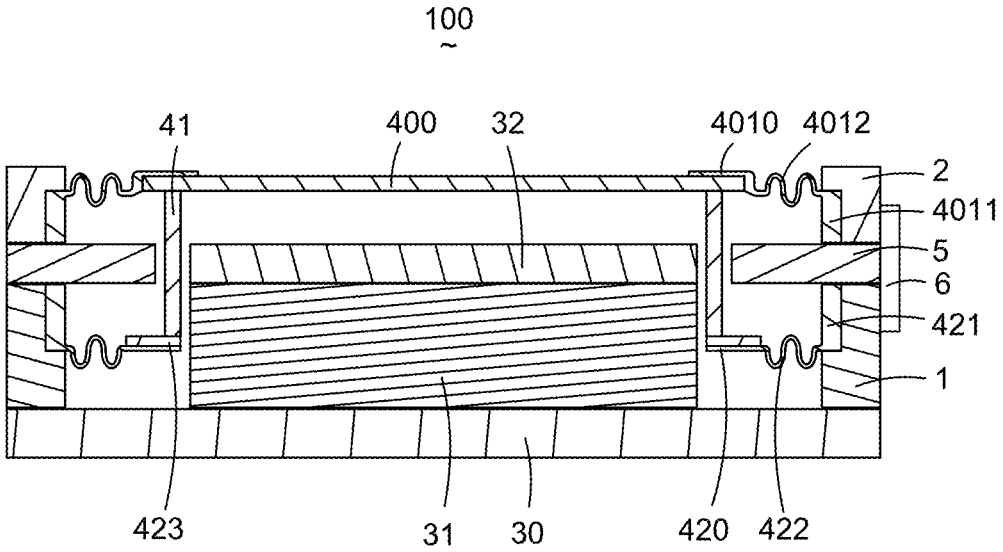
FIG. 2 is a cross-sectional view of the speaker in FIG. 1.

As shown in FIGS. 1 and 2, the exemplary embodiment of the present disclosure discloses a speaker 100 which comprises a frame 1, a front cover 2 creating a receiving space together with the frame, a magnetic circuit system 3 and vibration system 4 accommodated in the receiving space.

The vibration system 4 includes a vibrating diaphragm 40, a voice coil 41 which drives the vibrating diaphragm 40, and a silicone gel spider 42 which supports elastically the voice coil 41. The voice coil 41 is provided with upper and down ends. The upper end is fixed on the vibrating diaphragm 40 and the lower end is fixed on the silicone gel spider 42. The vibrating diaphragm 40 comprises a middle top dome 400 and a silicone gel edge ring 401 which is connected with the middle top dome 400 on the second internal circumferential part 4010. The top dome 400 is integrated with the silicone gel edge ring 401 by injection molding. The middle top dome 400 is stacked-up with the second internal circumferential part 4010. The voice coil 41 is fixed by glue on the middle top dome 400. Preferably, the middle top dome 400 is made of aluminum. Young's modulus of the middle top dome 400 is greater than that of the silicone gel edge ring 401.

The silicone gel edge ring 401 comprises a second external circumferential part 4011 which is integrated by injection molding on the front cover 2, a second deforming part 4012 which is connected with the second internal circumferential part 4010 and a second external circumferential part 4012 for creating elastic deformation. The second deforming part 4012 extends in form of waves along a direction vertical to the vibration direction of the voice coil 41.

The speaker 1 is provided with a high temperature resistant support ring 423 which is attached to the voice coil 41 and the silicone gel spider 42. The support ring 423 is connected to the voice coil 41 at the end away from the vibrating diaphragm 40. The support ring 423 is made from high temperature resistant material, such as polyimide, polyetherimide, polyethylene terephthalate and other high temperature polymeric material. In this utility model, preferably, the support ring 423 is made from polyimide. In this way, the high temperature created by the voice coil 41 after working will not have a significant impact on the physical properties of the support ring 423, thereby increasing greatly the bonding strength between the voice coil 41 and the support ring 423. In addition, the support ring 423 is integrated with the silicone gel spider 42 by injection molding for ensuring the structure stability of entire vibration system 4.

The silicone gel spider 42 includes a first internal circumferential part 420 which is integrated with the support ring 423 by injection molding, a first external circumferential part 421 which is integrated by injection molding on the frame 1, and a first deforming part 422 which is connected with the first internal circumferential part 420 and the first external circumferential part 421. The first deforming part 422 is extended in form of waves along a direction vertical to the vibration direction of the voice coil 41.

The speaker 100 further includes a gasket 5 which is located between the front cover 2 and the frame 1.

The front cover 2 is provided with a wire outgoing hole 20. The voice coil 41 comprises a voice coil wire 410 and the voice coil wire 410 is connected electrically with external circuit through this wire outgoing hole 20. In this utility model, the speaker 100 further includes a soldering pad 6. The voice coil wire 410 is fixed electrically by soldering with the soldering pad 6. The soldering pad 6 is connected electrically to an external electric circuit.

The magnetic circuit system 3 includes a yoke 30 installed on the lower portion of the frame 1, a magnet 31 installed on the yoke 30, a pole piece 32 installed on the magnet 31. The magnet 31 creates magnetic field around it. The voice coil 41 surrounds the magnet 31. The energized voice coil 41 interacts with the magnetic field, thereby drives the vibrating diaphragm 40 for generating sound.

In the speaker 1 disclosed in this embodiment, a high temperature resistant support ring 423 is provided between the voice coil 41 and the silicone gel spider 42, increases greatly the bonding strength between the voice coil 41 and the support ring 423, thereby enhances the structure stability of the vibration system 4 of the speaker 1.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a frame and a front cover creating a receiving space with the frame:

a magnetic circuit system;

a vibration system including a vibrating diaphragm, a voice coil for driving the vibrating diaphragm, a silicone gel spider elastically supporting the voice coil; wherein the speaker further includes a high temperature resistant support ring attached with the voice coil at an end far away from the vibrating diaphragm and the silicone spider;

the silicone gel spider includes a first internal circumferential part integrated with the support ring, a first external circumferential part fixed on the frame, and a first deforming part connected with the first internal circumferential part and the first external circumferential part, and the first deforming part extends in form of waves along a direction vertical to a vibration direction of the voice coil.

2. The speaker as described in claim 1, wherein the support ring is integrated with the silicone gel spider by injection molding.

3. The speaker as described in claim 1, wherein the support ring is made of polyimide.

4. The speaker as described in claim 1, wherein the vibrating diaphragm comprises a middle top dome and a silicone gel edge ring connected with the middle top dome on the second internal circumferential part, the middle top dome is stacked-up with the second internal circumferential part, and the voice coil is fixed with the middle top dome at an end close to the vibrational diaphragm.

5. The speaker as described in claim 4, wherein the middle top dome is made of aluminum.

6. The speaker as described in claim 4, wherein the silicone gel edge ring comprises a second external circumferential part integrated by injection molding with the front cover, and a second deforming part connected with the second internal circumferential part and the second external circumferential part for creating elastic deformation, and the second deforming part extends in form of waves along a direction vertical to the vibration direction of the voice coil.

7. The speaker as described in claim 1 further including a gasket located between the front cover and the frame.

8. The speaker as described in claim 7, wherein the front cover is provided with a wire outgoing hole, the voice coil comprises a voice coil wire and the voice coil wire is connected electrically with an external circuit through the wire outgoing hole.

* * * * *